US005193987A

United States Patent [19]

Iio et al.

[11] Patent Number: 5,193,987

[45] Date of Patent: Mar. 16, 1993

[54] SCROLL TYPE COMPRESSOR

[75] Inventors: Takayuki Iio, Nishikasugai; Yoshiharu Morita, Nagoya, both of Japan

[73] Assignee: Mitsubishi Jukogyo Kabushiki Kaisha, Tokyo, Japan

[21] Appl. No.: 753,373

[22] Filed: Aug. 30, 1991

[30] Foreign Application Priority Data

Nov. 14, 1990 [JP] Japan ..... 2-308194

[51] Int. Cl.[5] ..... F04B 49/00

[52] U.S. Cl. ..... 417/310; 417/299

[58] Field of Search ..... 417/310, 299

[56] References Cited

U.S. PATENT DOCUMENTS 4,846,633 7/1989 Suzuki et al. ..... 417/310
4,886,425 12/1989 Itahana et al. ..... 417/310
4,890,987 1/1990 Sato et al. ..... 417/310
5,059,098 10/1991 Suzuki et al. ..... 417/310

FOREIGN PATENT DOCUMENTS 0354867 2/1990 European Pat. Off. .
63-212789 9/1988 Japan .
62-264747 4/1989 Japan .

*Primary Examiner*—Richard A. Bertsch
*Assistant Examiner*—Alfred Basichas

[57] ABSTRACT

A scroll type compressor has a pair of bypass ports which communicate with a chamber being compressed which ports are bored in an end plate of a stationary scroll. An inner surface of a capacity control block of the compressor is separate from the stationary scroll and abuts against the outer surface of the end plate of the stationary scroll, thus forming a recessed portion which communicates with the pair of bypass ports therebetween. One cylinder of the compressor communicates with a suction chamber in a housing and is provided in the capacity control block and a piston operating by a control pressure in accordance with a load of the compressor is disposed slidably in the cylinder. A communicaton hole which communicates with the recessed chamber is opened and closed by the piston, thereby controlling the output capacity of the compressor in the range from 0 to 100%.

6 Claims, 8 Drawing Sheets

SCROLL TYPE COMPRESSOR

FIELD OF THE INVENTION AND RELATED ART STATEMENT

The present invention relates to a scroll type compressor which is suitable for an air conditioner for vehicles and the like.

FIG. 8 thru FIG. 10 show an example of a conventional scroll type compressor.

In FIG. 8, a closed housing 1 consists of a cup-shaped main body 2, a front end plate 4 fastened thereto with a bolt 3, and a cylindrical member 6 fastened thereto with a bolt 5. A main shaft 7 which penetrates through the cylindrical member 6 is supported rotatably by the housing 1 through bearings 8 and 9.

A stationary scroll 10 is disposed in the housing 1, and the stationary scroll 10 is provided with an end plate 11 and a spiral wrap 12 set up on the inner surface thereof, and the end plate 11 is fastened to the cup-shaped main body 2 with a bolt 13. The inside of the housing 1 is partitioned by having the outer circumferential surface of the end plate 11 and the inner circumferential surface of the cup-shaped main body 2 come into close contact with each other, thus forming a discharge cavity 31 on the outside of the end plate 11 and delimiting a suction chamber 28 on the inside of the end plate 11.

Further, a discharge port 29 is bored at the center of the end plate 11, and the discharge port 29 is opened and closed by means of a discharge valve 30 which is fastened to the outer surface of the end plate 11 together with a retainer 35 with a bolt 36.

A revolving scroll 14 is provided with an end plate 15 and a spiral wrap 16 which is set up on the inner surface thereof, and the spiral wrap 16 has essentially the same configuration as the spiral wrap 12 of the stationary scroll 10.

The revolving scroll 14 and the stationary scroll 10 are made eccentric with respect to each other by a radius of revolution in a solar motion, and are engaged with each other by shifting the angle by 180° as shown in the figure.

Thus, a tip seal 17 buried at a point surface of the spiral wrap 12 comes into close contact with the inner surface of the end plate 15, and a tip seal 18 buried at the point surface of the spiral wrap 16 comes into close contact with the inner surface of the end plate 11. The side surfaces of the spiral wraps 12 and 16 come into close contact with each other at points a, b, c and d so as to form a plurality of compression chambers 19*a* and 19*b* which form almost point symmetry with respect to the center of the spiral as shown in FIG. 10.

A drive bushing 21 is engaged rotatably through a bearing 23 inside a cylindrical boss 20 projected at a central part of the outer surface of the end plate 15, and an eccentric pin 25 projected eccentrically at the inner end of the main shaft 7 is inserted rotatably into an eccentric hole 24 bored in the drive bushing 21. Further, a balance weight 27 is fitted to the drive bushing 21.

A mechanism 26 for checking rotation on its own axis which also serves as a thrust bearing is arranged between an outer circumferential edge of the outer surface of the end plate 15 and the inner surface of the front end plate 4.

Now, when the main shaft 7 is rotated, the revolving scroll 14 is driven through a revolution drive mechanism consisting of the eccentric pin 25, the drive bushing 21 and the boss 20 and the like, and the revolving scroll 14 revolves in a solar motion on a circular orbit having a radius of revolution in a solar motion, i.e., quantity of eccentricity between the main shaft 7 and the eccentric pin 25 as a radius while being checked to rotate on its axis by means of the mechanism 26 for checking rotation on its axis. Then, linear contact portions a to d between the spiral wraps 12 and 16 move gradually toward the center of the spiral. As a result, the compression chambers 19*a* and 19*b* move toward the center of the spiral while reducing volumes thereof.

With the foregoing, gas which has flown into the suction chamber 28 through a suction port not shown is taken into respective compression chambers 19*a* and 19*b* through opening portions at outer circumferential ends of the spiral wraps 12 and 16 and reaches the central part while being compressed. The gas is discharged therefrom to a discharge cavity 31 by pushing a discharge valve 30 open through a discharge port 29, and outflows therefrom through a discharge port not shown.

A pair of cylinders 32*a* and 32*b* one end each of which communicates with the suction chamber 28 are bored and these pair of cylinders 32*a* and 32*b* are positioned on both sides of the discharge port 29 and extend in parallel with each other in the end plate 11 of the stationary scroll 10 as shown in FIG. 9 and FIG. 10. Further, bypass ports 33*a* and 33*b* for bypassing gas under compression to the above-mentioned cylinders 32*a* and 32*b* from the inside of the pair of compression chambers 19*a* and 19*b* are bored in the end plate 11. Further, pistons 34*a* and 34*b* for opening and closing the bypass ports 33*a* and 33*b* are inserted in a sealed and slidable manner into these cylinders 32*a* and 32*b*.

Further, at the bottom portion of the cup-shaped main body 21, a control valve 38 which penetrates through the bottom portion in a sealing manner and partly projects outside is fitted. This control valve 38 senses a discharge pressure and a suction pressure, and generates a control pressure which is an intermediate pressure of these pressures and may be expressed as a linear function of a low pressure.

When the compression is in full-load operation, the high pressure control gas generated at the control valve 38 is introduced to respective inner end surfaces of the pistons 34*a* and 34*b* via through holes 39*a* and 39*b*. Then, respective pistons 34*a* and 34*b* are made to advance against resiliency of return springs 41*a* and 41*b* which are interposed in a compressed state between those pistons and spring shoes 40*a* and 40*b*, thereby to block the bypass ports 33*a* and 33*b*.

On the other hand, the pressure of control gas generated from the control valve 38 is decreased when the compressor is in unload operation. Then, respective pistons 34*a* and 34*b* move back by the resiliency of the return springs 41*a* and 41*b* to occupy positions shown in the figure, and the gas which is being compressed passes through the bypass ports 33*a* and 33*b* from the pair of compression chambers 19*a* and 19*b* and outflows into the suction chamber 28 through communication holes 42*a* and 42*b* and blind holes 43*a* and 43*b* bored in the pistons 34*a* and 34*b* and the cylinders 32*a* and 32*b*.

In such a manner, capacity control is made in accordance with the load in the above-described scroll type compressor.

In the above-described conventional compressor, however, the compression chambers 19*a* and 19*b* are formed point-symmetrically with respect to the center of the spiral. Therefore, in order to bypass the gas which is being compressed to the suction chamber 28 side from these compression chambers 19*a* and 19*b*, respectively, it is required to form a pair of bypass ports 33*a* and 33*b* and a pair of cylinders 32*a* and 32*b* in the end plate 11, and to provide two sets of pistons 34*a* and 34*b*, return springs 41*a* and 41*b*, spring shoes 40*a* and 40*b* and the like in these pair of cylinders 32*a* and 32*b*, respectively. Therefore, there has been such a problem that the structure becomes complicated, thus increasing the number of parts and the assembly/working mandays and also increasing the cost and weight.

Further, since the pair of bypass ports 33*a* and 33*b* are bored by drilling, there has also been a problem that working mandays and mandays for deburring and the like are increased.

OBJECT AND SUMMARY OF THE INVENTION

It is an object of the present invention which has been made in view of such circumstances to provide a scroll type compressor for solving the above-described problems, and the gist thereof will be described hereunder.

A scroll type compressor in which a stationary scroll and a revolving scroll formed by setting up spiral wraps on an inner surface of an end plate, respectively, are made to engage with each other while shifting the angle so as to form a plurality of compression chambers point-symmetrically with respect to a center of a spiral, the stationary scroll is installed fixedly in a housing and the revolving scroll is made to revolve in a solar motion by means of a mechanism for driving revolution while checking rotation on its axis by a mechanism for checking rotation on its axis, thereby to move the compression chambers toward the center of the spiral while reducing volumes thereof so as to compress gas, thus discharging the compressed gas into a discharge cavity formed in the housing from a discharge port provided in an end plate of the stationary scroll, characterized in that a pair of bypass ports which communicate with the compression chambers are bored in the end plate of the stationary scroll, an inner surface of a capacity control block which is separate from the stationary scroll is made to abut against the outer surface of the end plate of the stationary scroll, a first recessed portion communicating with the pair of bypass ports is formed therebetween on the side of the capacity control block, one cylinder communicating with a suction chamber formed in the housing is provided in the capacity control block, and a piston operating by a control pressure in accordance with the load of the compressor is inserted into the cylinder in a sealed and slidable manner, thus opening and closing a first communication hole communicating with the recessed chamber by means of the piston.

The above described construction being provided in the present invention, it is operated so that the inner surface of the capacity control block is made to abut against the outer surface of the stationary scroll, thereby to form therebetween a recessed portion to which a pair of bypass ports communicate. Then, the capacity of the compressor is controlled by sliding the piston in the cylinder so as to open and close the communication hole.

According to the present invention, working of the stationary scroll and the capacity control block becomes easy and the cost of the compressor may be reduced by a large margin.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus are not limitative of the present invention, and wherein:

BRIEF DESCRIPTION OF THE DRAWINGS

FIG. 1 thru FIG. 7 show a first embodiment of the present invention, wherein:

FIG. 1 is a partial longitudinal sectional view;

FIG. 2 is a perspective view taken along a line II—II in FIG. 1;

FIG. 3 is a sectional view taken along a line III—III in FIG. 6;

FIG. 4 is a view taken along a line IV—IV in FIG. 6;

FIG. 5 is a sectional view taken along a line V—V in FIG. 4;

FIG. 6 is a sectional view taken along a line VI—VI in FIG. 4; and

FIG. 7 is a view taken along a line VII—VII in FIG. 5.

FIG. 8 thru FIG. 10 show an example of a conventional scroll type compressor, wherein:

FIG. 8 is a longitudinal sectional view;

FIG. 9 is a partial sectional view taken along a line IX—IX in FIG. 10; and FIG. 10 is a cross-sectional view taken along a line X—X in FIG. 8.

DETAILED DESCRIPTION OF A PREFERRED EMBODIMENT

Figure 1:
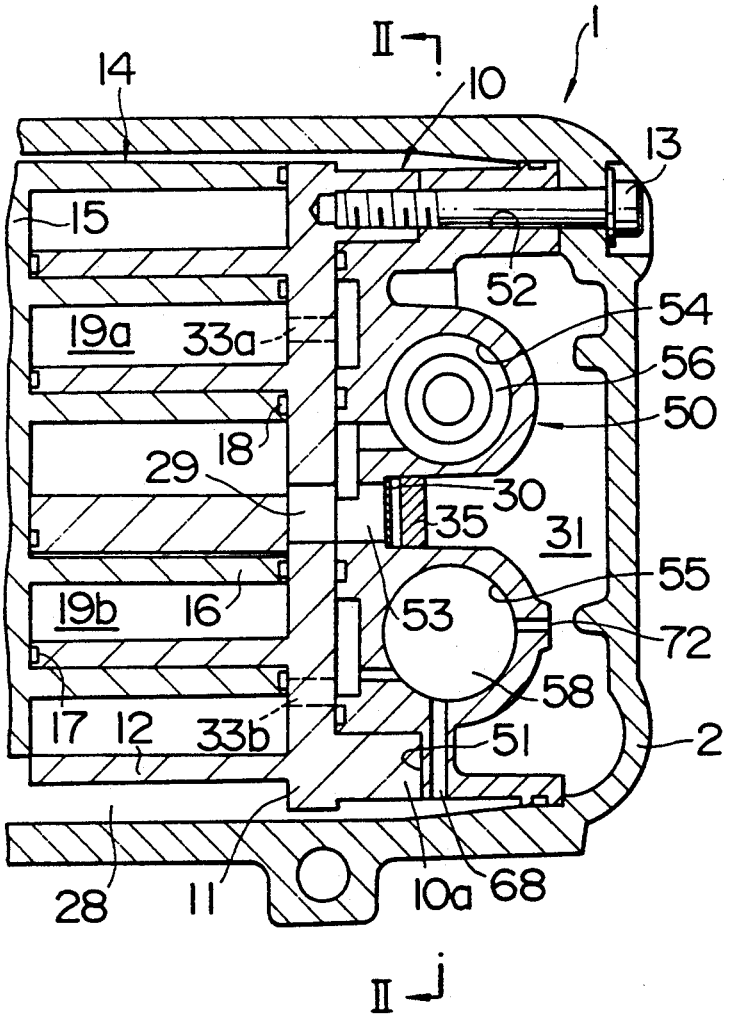
Figure 2:
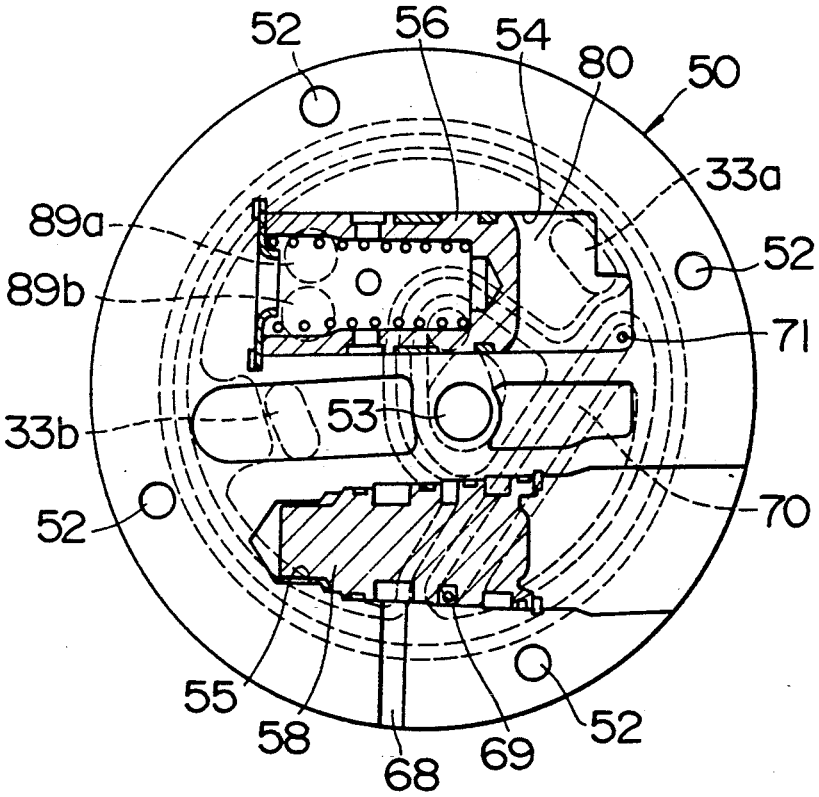
Figure 3:
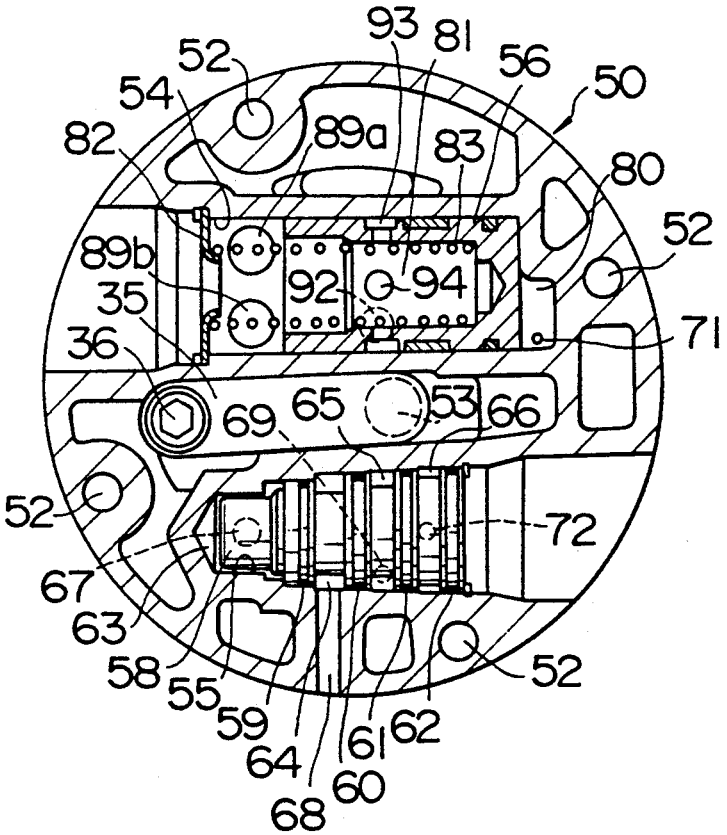
Figure 4:
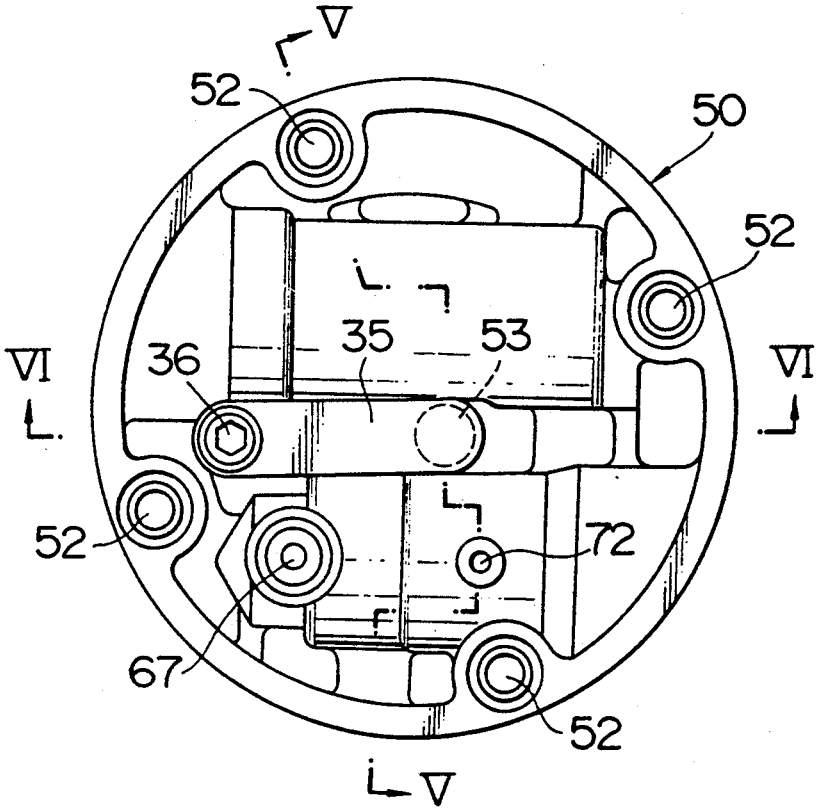
Figure 5:
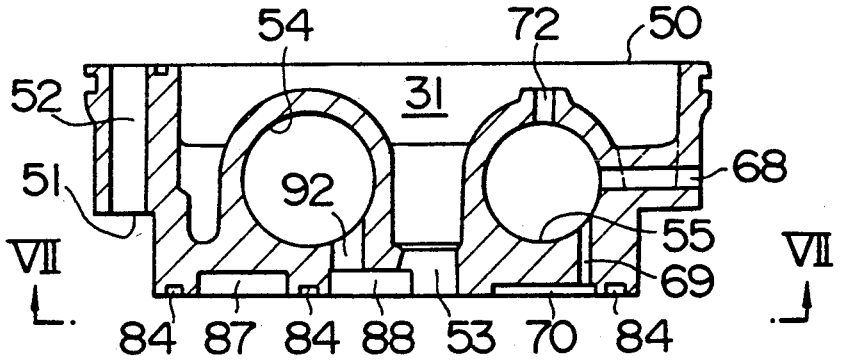
Figure 6:
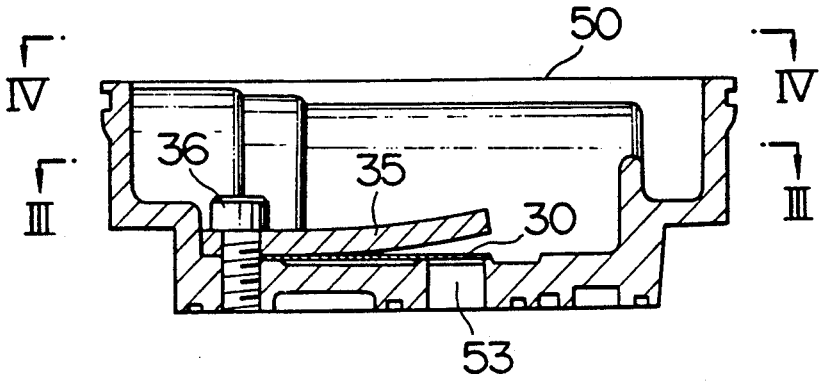

FIG. 1 thru FIG. 7 show an embodiment of the present invention.

A pair of bypass ports 33*a* and 33*b* which communicate with compression chambers 19*a* and 19*b* are bored in an end plate 11 of a stationary scroll 10. A capacity control block 50 is arranged so as to come into close contact with the outer surface of the end plate 11 of the stationary scroll 10. The capacity control block 50 is fixed in a housing 1 by fitting a fitting recessed portion 51 provided thereon to a fitting projected portion 10*a* provided on the stationary scroll 10, having a bolt 13 pass through a bolt hole 52 bored in the capacity control block 50 and screwing the point end thereof into the stationary scroll 10.

Then, the inside of the housing 1 is partitioned into a suction chamber 28 and a discharge cavity 31 by having the rear outer circumferential surface of the capacity control block 50 come into close contact in a sealed manner with an inner circumferential surface of a cup-shaped main body 2.

A discharge hole 53 communicating with a discharge port 29 is bored at the central part of the capacity control block 50, and the discharge hole 53 is opened and closed by means of a discharge valve 30 fastened to the outside surface of the capacity control block 50 with a bolt 36 together with a retainer 35.

A cylinder 54 having a blind hole shape is bored on one side of the discharge hole 53, and a hollow cavity 55 having a blind hole shape is bored in parallel with the cylinder 54 on another side, respectively, and opening ends of the cylinder 54 and the hollow cavity 55 communicate with the suction chamber 28, respectively.

A cup-shaped piston 56 is contained in the cylinder 54 in a sealed and slidable manner, and a control pressure chamber 80 is delimited on one side of the piston 56 and a chamber 81 delimited on another side communicates with the suction chamber 28. Further, the piston 56 is pushed toward the control pressure chamber 80 by a coil spring 83 interposed between the piston 56 and a spring shoe 82. Further, a ring recessed groove 93 bored on the outer circumferential surface of the piston 56 always communicates with the chamber 81 through a plurality of holes 94.

On the other hand, a control valve 58 is fitted into the hollow cavity 55, and an atmospheric pressure chamber 63, a low pressure chamber 64, a control pressure chamber 65 and a high pressure chamber 66 are delimited by partitioning a clearance between the hollow cavity 55 and the control valve 58 with O-rings 59, 60, 61 and 62. Further, the atmospheric pressure chamber 63 communicates with atmospheric air outside the housing 1 through a through hole 67 and a connecting pipe (not shown). The low pressure chamber 64 communicates with the suction chamber 28 through a through hole 68, the control pressure chamber 65 communicates with the control pressure chamber 80 through a through hole 69, a recessed groove 70 and a through hole 71, and the high pressure chamber 66 communicates with the discharge cavity 31 through a through hole 72.

Thus, the control valve 58 senses a high pressure HP in the discharge cavity 31 and a low pressure LP in the suction chamber 28, and generates a control pressure AP which is an intermediate pressure of these pressures and may be expressed as a linear function of a low pressure LP.

Figure 7:
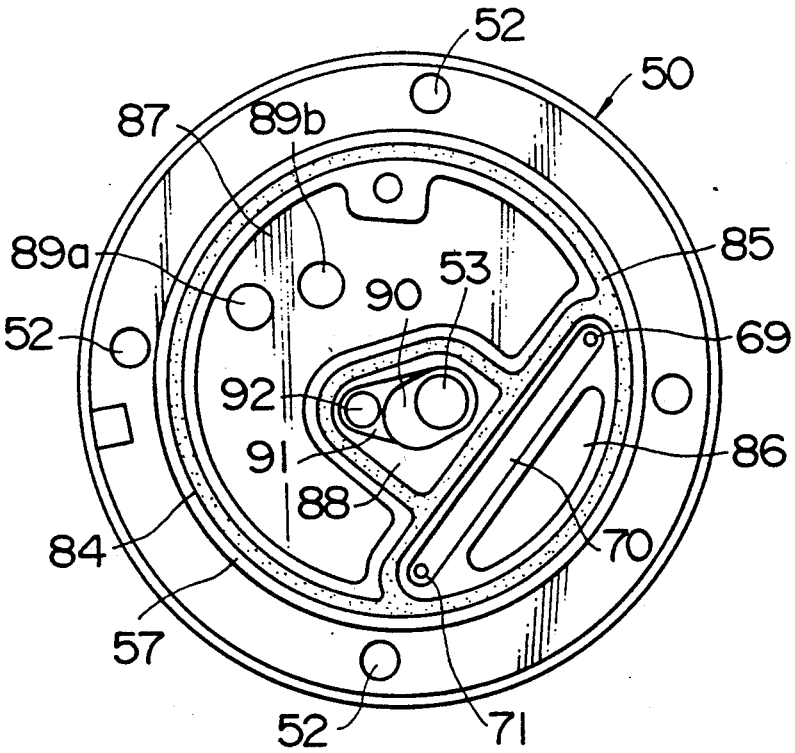

As shown in FIG. 7, recessed grooves 70, 90 and 91, a first recessed portion 86, a second recessed portion 87 and a third recessed portion 88 are bored on the inner surface of the capacity control block 50. A seal material 85 is fitted in a seal groove 84 bored at a land portion 57 surrounding these first, second and third recessed portions 86, 87 and 88. By having this seal material 85 come into close contact with the outer surface of the end plate 11 of the stationary scroll 10, these first, second and third recessed portions 86, 87 and 88 are formed between the capacity control block 50 and the outer surface of the end plate 11, and partitioned by means of the seal material 85. The first recessed portion 86 communicates with the control pressure chambers 65 and 80 through the recessed groove 70 and the through holes 69 and 71, the second recessed portion 87 communicates with compression chambers **19*a* and 19*b* which are being compressed through a pair of bypass ports 33*a* and 33*b* bored in the end plate 11 and communicates also with the chamber 81 of the cylinder 54 via through holes 89*a* and 89*b*, and the third recessed portion 88 communicates with a discharge hole 53 through the recessed grooves 90 and 91 and communicates also with the chamber 81 of the cylinder 54 through a communication hole 92**.

Besides, the bypass ports **33*a* and 33*b* are disposed at positions to communicate with the compression chambers 19*a* and 19*b*** during the period until the compression chambers enter into a compression process after terminating suction of gas, and the volume thereof is reduced to 50%.

Figure 8:
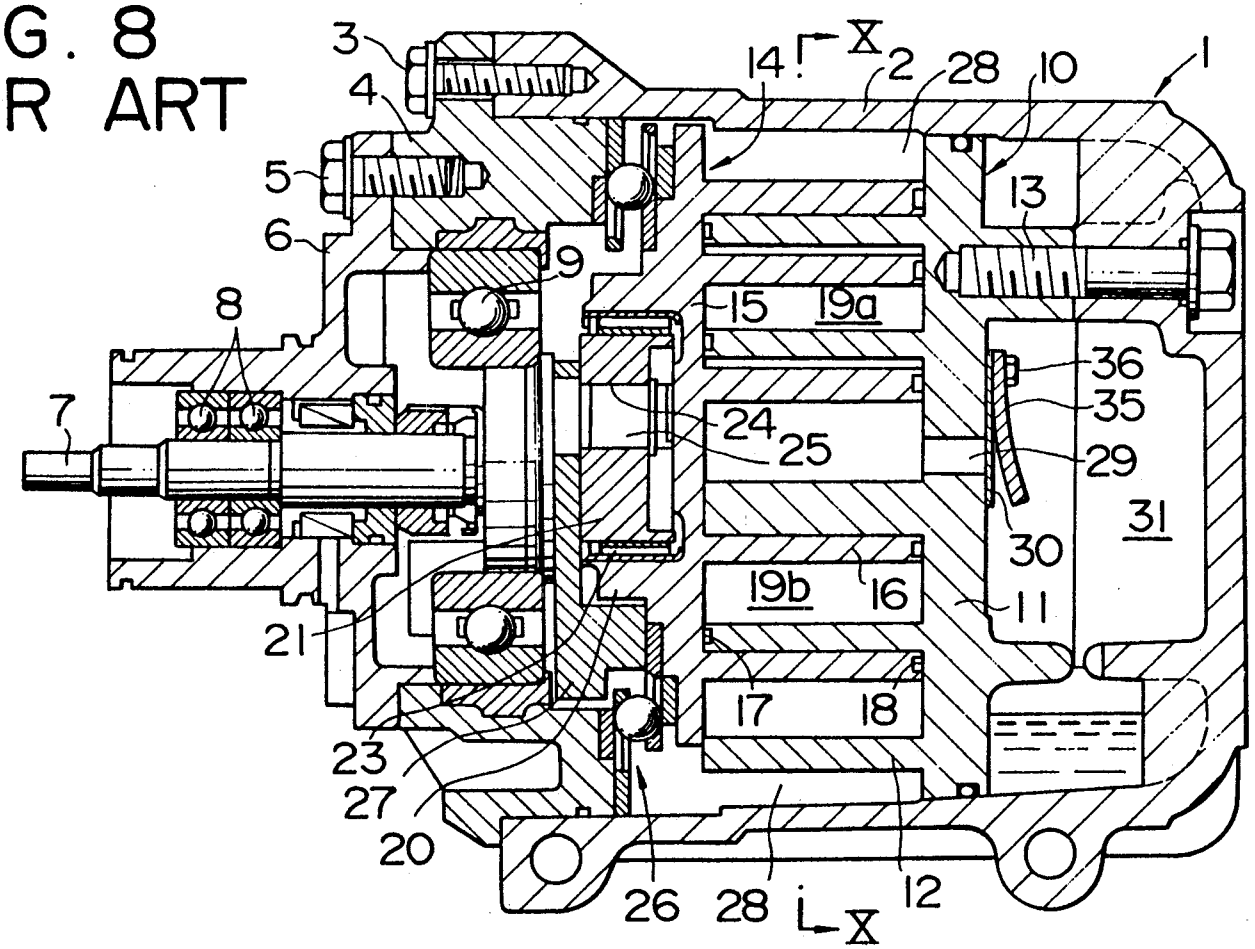
FIG. 8 PRIOR ART
Figure 9:
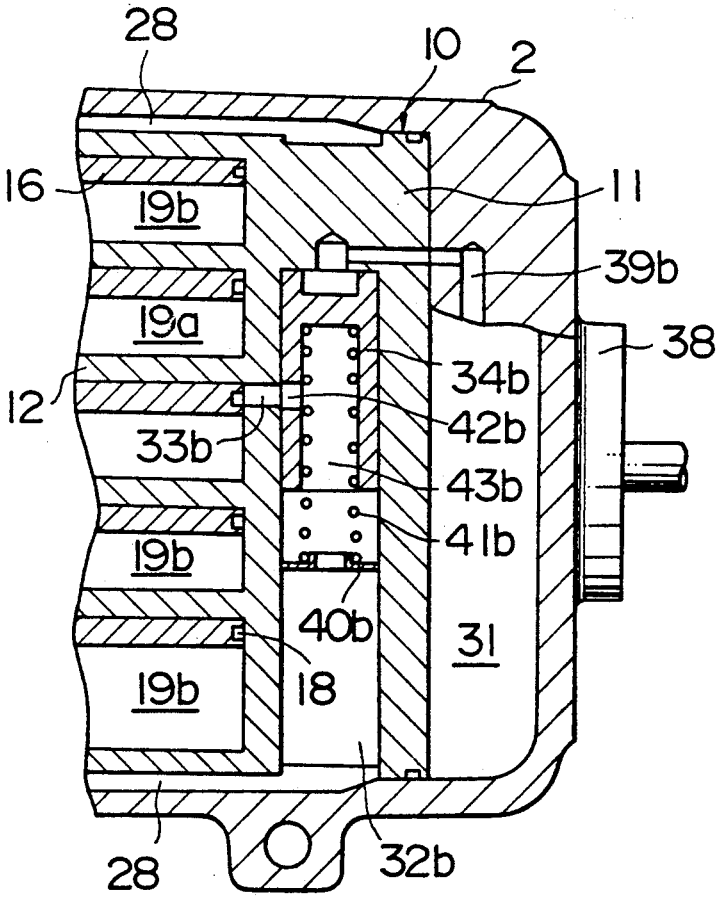
FIG. 9 PRIOR ART
Figure 10:
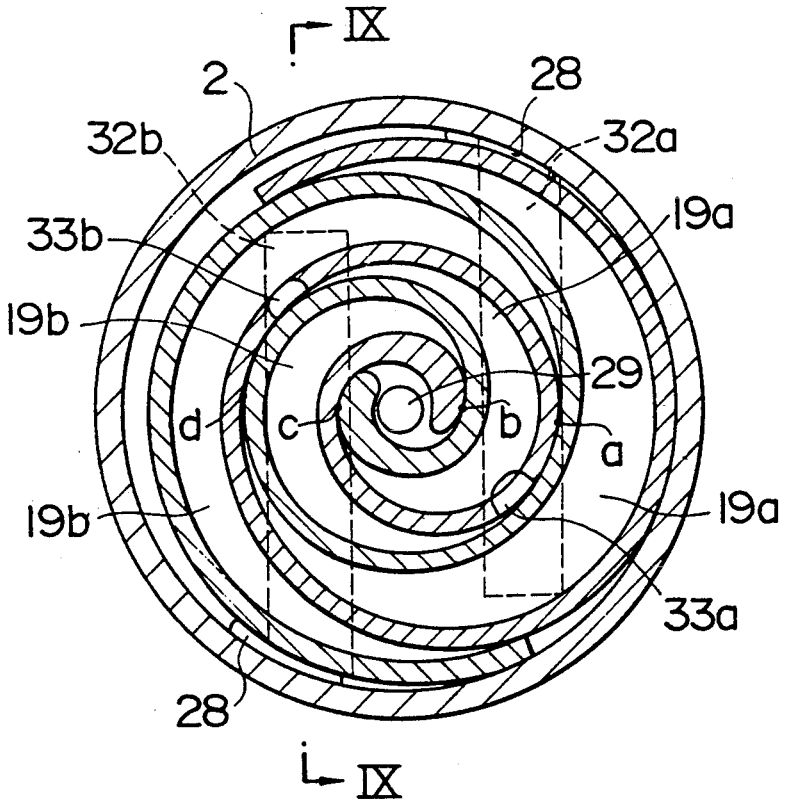
FIG. 10 PRIOR ART

Other construction is the same as that of a conventional apparatus illustrated in FIG. 8 thru FIG. 10, and the same reference numbers are affixed to corresponding members.

When the compressor is in an unload operation, the control pressure AP generated at the control valve 58 is lowered. When this control pressure AP is introduced into the control pressure chamber 80 through the through hole 69, the recessed groove 70 and the through hole 71, the piston 56 is pushed by a restoring force of a coil spring 83 and occupies a position shown in FIG. 3. Since the communication holes **89*a* and 89*b* and the communication hole 92 are thus opened, gas which is being compressed in the compression chambers 19*a* and 19*b* enters into the chamber 81 through bypass ports 33*a* and 33*b*, the second recessed portion 87, and the communication holes 89*a* and 89*b*. On the other hand, the gas in the compression chamber which has reached the center of the spiral, viz., the gas after compression enters into the chamber 81 through a discharge port 29, the discharge hole 53, the third recessed portion 88, recessed grooves 90 and 91, and the communication hole 92. These gases join together in the chamber 81 and are discharged into the suction chamber 28**. As a result, the output capacity of the compressor becomes zero.

When the compressor is in full-load operation, the control valve 58 generates a high control pressure AP. Then, the high control pressure AP enters into the chamber 80, and presses the inner end surface of the piston 56. Thus, the piston 56 moves back against the resiliency of the coil spring 83, and occupies a position where the outer end thereof abuts against the spring shoe 82, viz., a position shown in FIG. 2. In such a state, all of the communication holes **89*a* and 89*b* and the communication hole 92 are blocked by the piston 56. Therefore, the gas which is compressed in the compression chambers 19*a* and 19*b* and reaches the compression chamber at the central part of the spiral passes through the discharge port 29 and the discharge hole 53, and pushes the discharge valve 30 open so as to be discharged into the discharge cavity 31**, and then discharged outside through a discharge port not shown.

When the output capacity of the compressor is reduced, a control pressure AP corresponding to a reduction rate is generated in the control valve 58. When this control pressure AP acts onto the inner end surface of the piston 56 through the chamber 80, the piston 56 comes to a standstill at a position where the pressing force by the control pressure AP and the resiliency of the coil spring 83 are equilibrated. Accordingly, only the communication holes **89*a* and 89*b* are opened while the control pressure AP is low, the gas which is being compressed in the compression chambers 19*a* and 19*b* is discharged into the suction chamber 28 by the quantity corresponding to the opening of the communication holes 89*a* and 89*b*, and the output capacity of the compressor is reduced down to 50% when the communication holes 89*a* and 89*b* are fully opened. Furthermore, when the control pressure AP is lowered, the communication hole 92** is opened, and the output capacity of the compressor becomes zero when it is fully opened. In such a manner, it is possible to have the capacity of the compressor vary from 0% to 100% linearly.

In the above-described embodiment, the third recessed portion 88, the recessed grooves 90 and 91, the communication hole 92, the ring groove 93 and the hole 94 communicating with the discharge port 29 have been provided, but it is possible to omit them. In this case, the output capacity of the compressor may be varied between 50% and 100%. Further, it is also possible to set the output capacity variable range of the compressor appropriately by altering positions of the bypass ports 33*a* and 33*b* appropriately.

Further, it is also possible to bore the recessed portions 86 to 88 on the inner surface of the capacity control block 50.

According to the present invention, a pair of bypass ports which communicate with the compression chamber are bored in an end plate of a stationary scroll and an inner surface of a capacity control block which is separate from the stationary scroll is made to abut against the outer surface of the end plate of the stationary scroll, thus forming a recessed portion communicating with the pair of bypass ports therebetween, one cylinder which communicates with a suction chamber formed in the housing is provided in the capacity control block, and a piston which opens and closes a communication hole which communicates with the recessed chamber is fitted in a sealed and slidable manner in the cylinder. Thus, one each of cylinder and piston will suffice, and the capacity control block may be manufactured separately from the stationary scroll, and moreover, a recessed portion may be formed by having the inner surface of the capacity control block abut against the outer surface of the end plate of the stationary scroll. Accordingly, working of a stationary scroll and a capacity control block becomes easier, and the cost of a compressor may be reduced by a large margin.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A scroll type compressor comprises a stationary scroll and a revolving scroll formed by setting up spiral wraps on an inner surface of an end plate, respectively, are made to engage with each other while shifting the angle so as to form a plurality of compression chambers point-symmetrically with respect to a center of a spiral, said stationary scroll is installed fixedly in a housing and said revolving scroll is made to revolve in a solar motion by means of a mechanism for driving revolution while checking rotation on its axis by a mechanism for checking rotation on its axis, thereby to move said compression chambers toward the center of the spiral while reducing volumes thereof so as to compress gas, thus discharging the compressed gas into a discharge cavity formed in said housing from a discharge port provided in an end plate of said stationary scroll, the scroll type compressor further comprises a pair of bypass ports which communicate with said compression chambers, the bypass ports are bored in the end plate of said stationary scroll, an inner surface of a capacity control block which is separate from said stationary scroll is made to abut against the outer surface of the end plate of said stationary scroll, a first recessed portion communicating with said pair of bypass ports is formed therebetween on the side of said capacity control block, one cylinder communicating with a suction chamber formed in said housing is provided in said capacity control block, and a piston operating by a control pressure in accordance with the load of said compressor is inserted into the cylinder in a sealed and slidable manner, thus opening and closing a first communication hole communicating with said recessed chamber by means of said piston.

2. The scroll type compressor according to claims 1, wherein said pair of bypass ports are bored at positions where the output capacity of said compressor is at 50%.

3. The scroll type compressor according to claim 1, further comprising a second recessed portion communicating with said discharge port is formed on the inner surface of said capacity control block, a second communication hole which communicates between said second recessed portion and said cylinder is also provided, and said second communication hole is opened and closed by said piston.

4. The scroll type compressor according to claim 3, wherein said pair of bypass ports are bored at positions where the output capacity of said compressor is at 50%, said second recessed portion and said second communication hole which communicate with said discharge port are also provided, and said first communication hole and said second communication hole are opened and closed successively by said piston, thereby to change the output capacity of said compressor between 100% and 0% continuously.

5. The scroll type compressor according to claim 4, wherein said first recessed portion and said second recessed portion are partitioned by a seal material fitted in a seal groove provided on the inner surface of said capacity control block.

6. The scroll type compressor according to claim 5, wherein said seal material is formed by forming an outer circumferential portion partitioning the section chamber side and a partitioning portion which partitions between both first and second recessed portions in one body.

* * * * *